US009617092B2

(12) United States Patent
Muller

(10) Patent No.: US 9,617,092 B2
(45) Date of Patent: Apr. 11, 2017

(54) DEVICE AND METHOD FOR SEPARATING VALUE DOCUMENTS, AND VALUE DOCUMENT PROCESSING SYSTEM

(71) Applicant: GIESECKE & DEVRIENT GMBH, Munich (DE)

(72) Inventor: Julian Muller, Poing (DE)

(73) Assignee: GIESECKE & DEVRIENT GMBH, Munich (DE)

( * ) Notice: Subject to any disclaimer, the term of this patent is extended or adjusted under 35 U.S.C. 154(b) by 21 days.

(21) Appl. No.: 14/413,075

(22) PCT Filed: Jul. 4, 2013

(86) PCT No.: PCT/EP2013/001969
§ 371 (c)(1),
(2) Date: Jan. 6, 2015

(87) PCT Pub. No.: WO2014/005715
PCT Pub. Date: Jan. 9, 2014

(65) Prior Publication Data

US 2015/0203306 A1 Jul. 23, 2015

(30) Foreign Application Priority Data

Jul. 6, 2012 (DE) ..... 10 2012 013 517

(51) Int. Cl.
*B65H 3/04* (2006.01)
*B65H 3/62* (2006.01)

(52) U.S. Cl.
CPC ..... *B65H 3/042* (2013.01); *B65H 3/62* (2013.01); *B65H 2301/42322* (2013.01);
(Continued)

(58) Field of Classification Search
CPC ..... B65H 3/042; B65H 3/12; B65H 3/124; B65H 3/126; B65H 3/04; B65H 3/045;
(Continued)

(56) References Cited

U.S. PATENT DOCUMENTS 3,406,963 A * 10/1968 Goss ..... 271/35
3,941,372 A * 3/1976 Matsuo ..... 271/95
(Continued)

FOREIGN PATENT DOCUMENTS

DE 3202037 A1 11/1982
DE 69002188 T2 11/1993
(Continued)

OTHER PUBLICATIONS

German Search Report for corresponding German Application No. 10 2012 013 517.3, Apr. 30, 2013.
(Continued)

*Primary Examiner* — Ernesto Suarez
(74) *Attorney, Agent, or Firm* — Workman Nydegger

(57) ABSTRACT

An apparatus and a corresponding method for singling value documents, in particular banknotes, includes a support means and a conveyor belt for picking a single value document from a stack of value documents lying on the support means. The singling device has a positioning device by which at least a portion of the conveyor belt can be moved back and forth relative to the support means between a first position and a second position. In the first position the conveyor belt cannot touch the stack lying on the support means. In the second position the conveyor belt can touch the lowermost value document of a stack lying on the support means and pick the former from the stack at least partially.

17 Claims, 5 Drawing Sheets

(52) U.S. Cl.
CPC .. *B65H 2403/514* (2013.01); *B65H 2404/252* (2013.01); *B65H 2404/255* (2013.01); *B65H 2701/1912* (2013.01)

(58) Field of Classification Search
CPC ..... B65H 2301/42322; B65H 2404/26; B65H 2404/2615; B65H 2404/2614; B65H 2404/269; B65H 2404/253; B65H 2404/254; B65H 2404/255; B65H 2404/256; B65H 2404/2532
See application file for complete search history.

(56) References Cited

U.S. PATENT DOCUMENTS

| | | | | | |
|---|---|---|---|---|---|
| 3,990,694 | A | * | 11/1976 | Mason et al. | 271/35 |
| 4,236,708 | A | * | 12/1980 | Matsuo | 271/12 |
| 4,369,961 | A | * | 1/1983 | Gopel et al. | 271/35 |
| 4,867,433 | A | * | 9/1989 | Wells | B65H 7/18 271/114 |
| 5,026,040 | A | * | 6/1991 | Gibert | B65H 3/12 271/108 |
| 5,074,539 | A | * | 12/1991 | Wells et al. | 271/12 |
| 5,163,666 | A | | 11/1992 | Kuo | |
| 5,201,508 | A | * | 4/1993 | Kuo | 271/10.03 |
| 5,244,197 | A | * | 9/1993 | Helmstadter | 271/35 |
| 6,164,432 | A | | 12/2000 | Monsees | |
| 6,412,770 | B1 | | 7/2002 | Demmeler | |
| 6,418,847 | B1 | | 7/2002 | Holecek | |
| 8,353,510 | B2 | * | 1/2013 | Lindsay et al. | 271/251 |
| 8,408,532 | B2 | * | 4/2013 | Higaki | B65H 3/18 271/18.1 |

FOREIGN PATENT DOCUMENTS

| | | | |
|---|---|---|---|
| DE | 69208010 | T2 | 7/1996 |
| DE | 10219982 | C1 | 7/2003 |
| EP | 1084072 | B1 | 8/2003 |
| EP | 1803668 | A1 | 7/2007 |

OTHER PUBLICATIONS

International Search Report for corresponding International PCT Application No. PCT/EP2013/001969, Oct. 9, 2013.

* cited by examiner

DEVICE AND METHOD FOR SEPARATING VALUE DOCUMENTS, AND VALUE DOCUMENT PROCESSING SYSTEM

BACKGROUND

The invention relates to an apparatus and a method for singling value documents, in particular banknotes, and a banknote processing system according to the preamble of the independent claims.

Such apparatus and methods are used in particular in banknote processing systems in order to pick banknotes respectively individually from a stack of banknotes and transfer them to a transport device conveying the banknotes to checking, counting, sorting and/or stacking devices for further processing.

From EP 1 084 072 B1 an apparatus and a corresponding method for singling banknotes are known, wherein a movably mounted rocker is moved periodically together with the banknote stack lying on the rocker towards and away from a circulating conveyor belt. Due to the relatively large number and total mass of the components moved during the rocking movement, upon accelerating and braking the rocker relatively great inertial forces occur which require a correspondingly powerful drive and can result in a comparatively high noise emission.

SUMMARY

It is an object of the present invention to specify an apparatus and a corresponding method for singling value documents, in particular banknotes, as well as a value-document processing system, wherein the noise emission is lower than so far.

The apparatus according to the invention has a support means and a conveyor belt for picking a single value document from a stack of value documents lying on the support means, and is characterized by a positioning device through which at least one portion of the conveyor belt can be moved back and forth relative to the support means between a first position and a second position, wherein the conveyor belt in the first position cannot touch the stack lying on the support means, and the conveyor belt in the second position can touch a value document of the stack lying on the support means, and thereby can pick the value document from the stack at least partially.

The value-document processing system according to the invention has an apparatus for processing, in particular conveying and/or checking and/or counting and/or sorting value documents and is characterized by the apparatus for singling according to the invention.

The method according to the invention, wherein single value documents are picked from a stack of value documents lying on a support means by means of a conveyor belt is characterized in that at least a portion of the conveyor belt is moved back and forth relative to the support means between a first position and a second position, wherein the conveyor belt in the first position does not touch the stack lying on the support means, and the conveyor belt in the second position touches the lowermost value document of the stack lying on the support means, thereby picking the lowermost value document from the stack at least partially.

The invention is based on the idea of continuously moving back and forth at least a portion of the conveyor belt facing the banknote stack lying on the support means relative to the support means between at least two extreme positions, wherein the circulating conveyor belt disposed in an upper extreme position can touch the respectively lowermost value document of the stack lying on the support means, picking it from the stack at least partially, whereas the conveyor belt disposed in a lower extreme position does not touch the stack lying on the support means. By the continuous backward and forward movement of the conveyor belt from the lower to the upper extreme position and back, the respectively lowermost value document of the stack disposed on the support means is continuously picked at least partially by the conveyor belt. The respectively picked value document can be supplied to a further transport device which can then convey the former to further apparatus for processing the value document.

Whereas the conveyor belt or a portion of the conveyor belt is moved towards the value document stack and away from the value document stack, the value document stack resting on the support means, and in particular the support means itself, maintains its stationary spatial position. Consequently only the conveyor belt or a portion of the conveyor belt is moved back and forth, in particular up and down. By a contact of the circulating conveyor belt with the respectively lowermost value document of the stack, this document is picked from the stack due to thereby occurring friction forces. When the conveyor belt or the moved portion of the conveyor belt has reached the lower extreme position, the former no longer touches the stack, so that the singling process is stopped temporarily. Only when the conveyor belt or a portion of the conveyor belt is brought back to the upper extreme position is a new singling process started.

Compared to the apparatus and methods known from the state of the art, the apparatus and/or the corresponding method according to the invention can be realized with a smaller number of moved parts and a smaller total mass of the moved parts. The inertial forces occurring upon movement of the parts are correspondingly lower, so that the required driving power and the noise emission connected to the operation of the apparatus or of the method is reduced. Moreover, due to the reduced number of moved parts higher functional reliability is achieved in a simple fashion, due to the correspondingly shorter tolerance chain of the mechanically mutually coupled components.

Preferably the support means stands still at least during the movement of the conveyor belt from the first to the second position and vice versa. Thereby the total mass moved upon singling is kept particularly low. The support means is arranged to be stationary in the apparatus in particular. A stationary arrangement of the support means is to be understood in such a way here that the support means stands still during the movement of the conveyor belt relative to the support means, but can in principle be mounted in the apparatus so that its spatial position is adjustable, for example during assembly or for maintenance purposes.

In a further preferred embodiment the positioning device has at least a first diverting element, in particular a first diverting roll, for diverting the conveyor belt. A diversion of the conveyor belt is to be understood here in particular to mean that the substantially linearly extending portions of the conveyor belt adopt different angles, for example with reference to the horizontal, on the two sides of the diverting element. Thereby a change in position of the conveyor belt can be realized in a particularly simple fashion.

Preferably a compensating element is provided, by which possible changes of the length of the conveyor belt that can occur upon the positioning of the conveyor belt, are compensated at least partially. Thereby mechanical stress of the conveyor belt and of the components required for circulation and the upward and downward movement can be reduced to a minimum.

Furthermore, it is preferred that the compensating element has at least a second diverting element, in particular a second diverting roll, for diverting the conveyor belt. Thereby a compensating movement accompanying the position change of the conveyor belt in order to compensate the change in length of the conveyor belt can be realized in a particularly simple fashion.

In a particularly preferred embodiment the first diverting element and/or the second diverting element is configured as an eccentric. An eccentric is to be understood here as a configuration of the diverting elements wherein the latter have both a rotatory and a translatory movement component. Thereby a movement of the first and/or second diverting element, in particular configured as a diverting roll, between two extreme positions can be produced in a particularly simple fashion, thereby keeping the number of required components low.

As an alternative to eccentric diverting rolls also diverting rolls with non-circular cross section can be employed, e.g. with an elliptical cross section, or diverting elements of lever-shaped configuration, that can move up and down continuously.

It is further preferred that the first and the second diverting element are so mutually coupled that upon a movement of the first diverting element a synchronous counter-movement of the second diverting element takes place. Thereby a particularly reliable compensation of changes of length of the conveyor belt is ensured.

In particular the first diverting element is arranged on a first gearwheel, and the second diverting element is arranged on a second gearwheel, wherein the first and the second gearwheel are mutually engaged. In particular, the first and the second diverting element is arranged respectively eccentrically to the rotational axis of the first and/or second gearwheel. Thereby a synchronous counter-movement of the second diverting element to the first diverting element can be realized in a constructively particularly simple and robust fashion, so that the number and mass of the required components are kept low. Instead of a toothed-wheel coupling, the synchronous counter-movement can also be achieved by a different coupling of the movement of the first and the second diverting element, e.g. by a mechanical coupling by means of a belt.

It is further preferred that the conveyor belt is moved back and forth between the first position and the second position by an oscillating, in particular periodical, movement of the positioning device. An oscillating movement of the positioning device here is to be understood to mean any movement wherein the positioning device moves the conveyor belt or a portion of the conveyor belt back and forth between at least two different positions in a spatially and/or temporally substantially regular fashion. Thereby a regular picking of banknotes from the stack of banknotes is ensured in a constructively simple fashion.

Preferably one or several retaining elements are provided by which the further value documents of the stack can be retained, while the lowermost value document picked from the stack at least partially can be conveyed through a singling gap disposed between the retaining elements and the support means and/or the conveyor belt. The retaining elements can be arranged in stationary fashion, wherein they stand still relative to the support means in particular during the movement of the conveyor belt. Fundamentally, the retaining means arranged in stationary fashion can be so mounted in the apparatus, however, that their spatial position is adjustable, for example during assembly or for maintenance purposes. As an alternative to the stationary arrangement, the retaining elements can be so configured that they can move toward the conveyor belt and/or the support means and away again therefrom. The movement of the retaining elements is preferably time-coordinated with the movement of the conveyor belt by means of the positioning device, e.g. by mechanical coupling of the two movements. In particular it can be provided that the retaining elements carry out an oscillating movement at the same frequency as the upward and downward movement of the conveyor belt. Thereby the width of the singling gap can be varied in targeted fashion, in order to ensure a reliable picking of the respectively lowermost banknote on the one hand and an effective blocking of successive banknotes of the stack on the other hand. The number of moved components is relatively low also in this embodiment.

In a further advantageous embodiment of the invention a third diverting element is provided, in particular in the form of a third diverting roll, which is arranged in the region of the retaining elements and by which the width of the singling gap between the retaining elements and the conveyor belt can be predetermined. In particular the width of the singling gap can hereby be adjusted in targeted fashion to a fixed value which does not or not substantially change during the upward and downward movement of the conveyor belt. The third diverting element holds back the conveyor belt during its downward movement in that conveyor belt portion which lies at the singling gap in such a fashion that the singling gap remains substantially the same despite the downward movement of the conveyor belt. Alternatively, the third diverting element can be configured to be movable in such a fashion that it moves within predeterminable limits, in particular during the upward and downward movement of the conveyor belt, whereby respectively different, defined widths of the singling gap can be adjusted. Also thereby a reliable picking of banknotes is ensured while successive banknotes of the stack are retained effectively, without significantly increasing the number of moved components.

In a further preferred embodiment of the invention at least one blocking element is provided which can be guided towards at least a part of the retaining elements and can thereby prevent a picking of further value documents from the stack, while the lowermost value document picked from the stack at least partially is conveyed through the singling gap. Also in this variant of the invention a reliable picking of banknotes is achieved while successive banknotes are securely retained at the same time, wherein the total number of moved components is kept relatively low.

BRIEF DESCRIPTION OF THE DRAWINGS

Further advantages, features and application possibilities of the present invention will result from the following description in connection with the figures. The figures are described as follows.

DETAILED DESCRIPTION OF VARIOUS EMBODIMENTS

Figure 1:
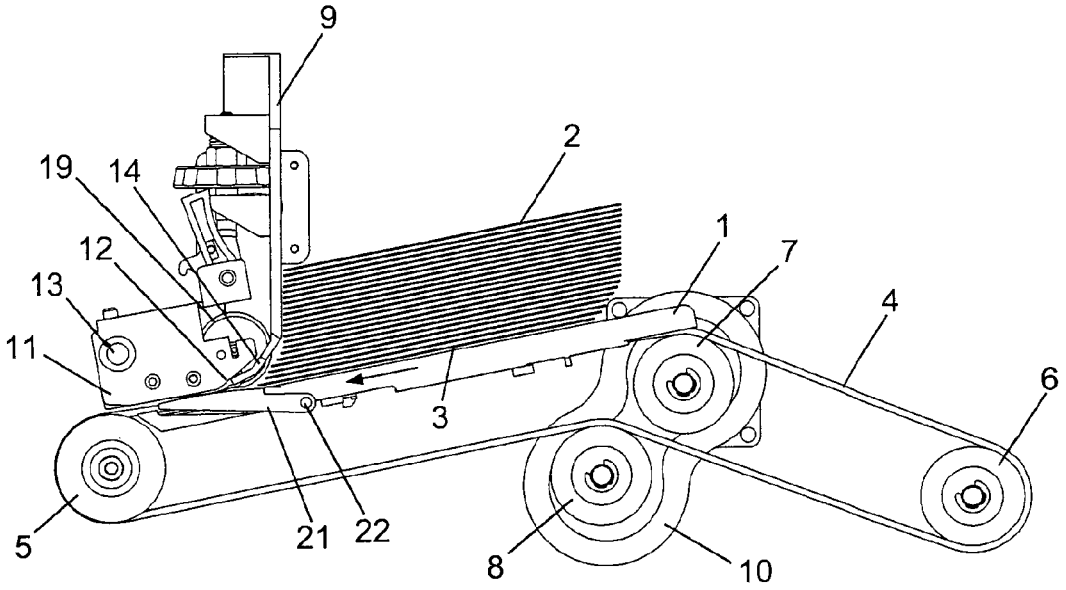
FIG. 1 a first example of the apparatus according to the invention in a side view having a first diverting roll disposed in a lower position.

FIG. 1 shows a first example of the apparatus according to the invention in a side view. The apparatus has a support means 1 on which a stack 2 of banknotes is placed, wherein the respectively lowermost banknote 3 of the stack 2 rests directly on the support means 1. Further a conveyor belt 4 is provided which is preferably configured as an endless belt and is driven by a drive roller 5 caused to rotate, for example by a motor, and is diverted by means of a diverting roller 6, a first diverting roll 7 as well as a second diverting roll 8. By causing the drive roller 5 to rotate counterclockwise, the conveyor belt 4 circulates in the direction indicated by an arrow.

In the phase represented in FIG. 1, the first diverting roll 7 is disposed in a lower position, so that the portion of the conveyor belt 4 disposed between the drive roller 5 and the first diverting roll 7 extends at a distance from the lowermost banknote 3 of the banknote stack 2 and cannot touch the lowermost banknote 3. In this position this portion of the conveyor belt 4 preferably extends parallel to the support means 1 and/or to the stack 2.

Figure 2:
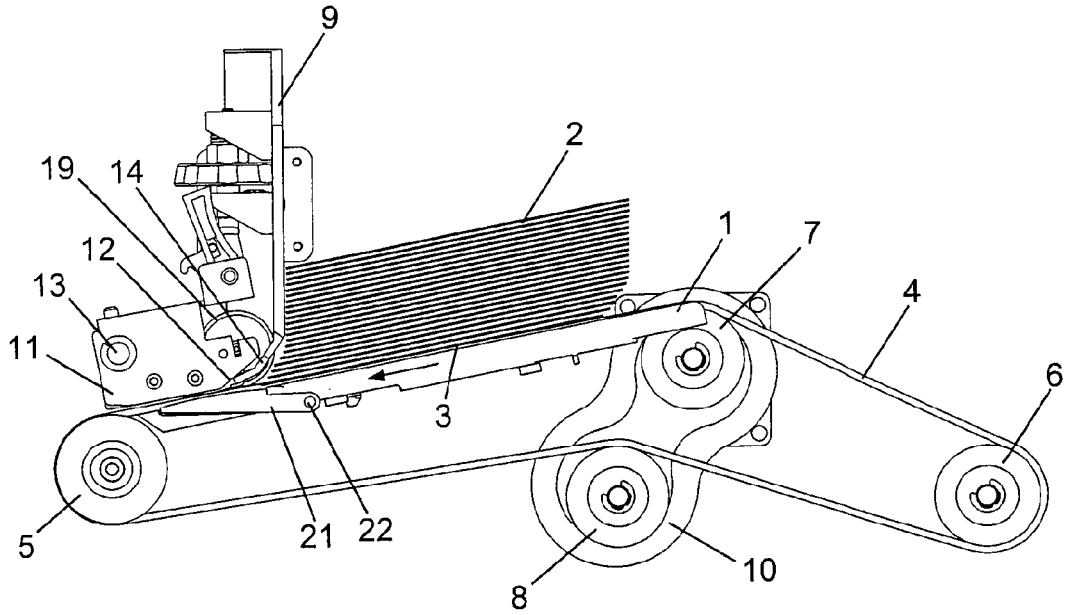
FIG. 2 the first example of the apparatus shown in FIG. 1 with the first diverting roll disposed in an upper position.

The first diverting roll 7 is so configured that it can be brought from the lower position shown in FIG. 1 to an upper position represented in FIG. 2, whereby the portion of the conveyor belt 4 extending between the drive roller 5 and the first diverting roll 7 is moved in the direction of the lowermost banknote 3 of the banknote stack 2 and touches the lowermost banknote 3 in the second position shown in FIG. 2. This portion of the conveyor belt 4 in this position extends somewhat obliquely to the support means 1 and therefore initially touches the part of the lowermost banknote 3 that is in front in the circulation direction. Due to the frictional forces occurring herein between the conveyor belt 4 and the lowermost banknote 3 that are greater than the frictional forces occurring between the lowermost banknote 3 and the next banknote disposed in the stack 2, the lowermost banknote 3 is picked from the stack 2 in the direction of the drawn arrow and conveyed to a (not shown) transport device disposed to the left of the shown apparatus in FIG. 1. The transport device then supplies the banknote 3 to individual processing devices of a banknote processing system.

The support means 1 preferably has two or more support strips on which the banknote stack 2 rests and between which the conveyor belt 4 extends. Moreover, an areally configured stop 9 is provided at which the individual banknotes of the banknote stack 2 placed on the support means 1 can be oriented.

Further, a retaining device 11 is provided having retaining runners 12 that are beveled towards the banknote stack 2. One or several pressure rolls 19 are mounted on the retaining device 11 by means of an essentially vertically extending groove to be freely rotatable and vertically displaceable within the groove. The pressure rolls 19 together with the guide runners 14 arranged in extension of the areally configured stop 9 prevent a fanning out of the banknote stack 2.

As already explained, for a reliable picking of the lowermost banknote 3, the frictional forces between the banknote 3 and the conveyor belt 4 must be greater than the frictional forces between the lowermost banknote 3 and the successive banknote in the stack 2. This is ensured with great reliability in the presently described exemplary embodiment also by configuring the conveyor belt as a so-called friction belt, the material of which and/or surface properties of which are so chosen that the required frictional forces occur upon contact with a banknote to be singled.

In order to further increase the frictional forces between the lowermost banknote 3 and the conveyor belt 4, and in particular to produce a sticking friction, it is possible to push or pull the respectively lowermost banknote 3 of the stack 2 against the conveyor belt 4 with the aid of an additional device. To realize for example a suction of the banknote 3 to the conveyor belt 4, the conveyor belt 4 can be equipped with holes and an air suction device (not shown) can be provided that is arranged below the conveyor belt 4, preferably in the region below the singling gap, and above which there extends the conveyor belt 4 equipped with holes. As soon as the portion of the conveyor belt 4 to be moved in the direction of the second position comes near the lowermost banknote 3 or touches it, the banknote 2 is sucked towards the conveyor belt due to an air flow caused by sucking air through the holes of the conveyor belt 4, wherein the generated normal forces and the frictional forces resulting therefrom between the banknote 3 and the conveyor belt 4 are greater than without suction. Preferably the suction device is switched on only when the portion of the conveyor belt 4 is disposed in the second position or near the second position, and is preferably switched off when the conveyor belt 4 is disposed in the first position. Thereby the generation of additional frictional forces between the banknote 3 and the conveyor belt 4 can be controlled in targeted fashion.

Between the conveyor belt 4 and/or the support means 1 on the one hand and the retaining runners 12 on the other hand a singling gap is formed, through which the lowermost banknote 3 respectively picked from the banknote stack 2 can be conveyed.

In the represented example one or several blocking elements 21 are provided on the support means 1 which can at least partially close and re-open the singling gap formed between the support means 1 and the retaining runners 12. In the represented example the blocking elements 21 are configured as levers that can be pivoted about a pivot axis 22. The blocking elements 21 are advantageous particularly in such embodiments of the apparatus wherein the conveyor belt 4 upon moving from the second position (see FIG. 2) to the first position (see FIG. 1) is lowered in the region of the retaining runners 12, thereby continuously widening the singling gap in the region of the conveyor belt 4 on the one hand and the retaining runners 12 on the other hand. In order to prevent that the currently picked lowermost banknote 3 entrains further banknotes of the banknote stack 2 (so-called double or multiple pick), the blocking elements 21 are temporarily inserted at least partially in the singling gap, so that the latter is closed at least partially, thereby preventing an entrainment of further banknotes from the banknote stack 2.

For example the blocking elements 21 are configured as active blocking elements which are inserted in and withdrawn from the singling gap by a drive of their own, for example a mechanical and/or electromechanical drive, as represented in FIG. 1 (inserted) and/or FIG. 2 (withdrawn). Alternatively, the movement of the blocking elements 21 can also be achieved by mechanical coupling with the upward and downward movement of the conveyor belt 4.

In the example of the apparatus according to the invention shown in FIGS. 1 and 2 the retaining device 11 can be pivotally mounted about a pivot axis 13. The retaining device 11 can be so coordinated with the movement of the first diverting roll 7 that the width of the singling gap between the retaining runners on the one hand and the support means 1 and/or the conveyor belt 4 on the other hand changes with the movement of the first diverting roll 7. It can be achieved thereby that the singling gap opens slightly during the downward movement of the conveyor belt 4 from the second position in the direction of the first position, aiding or, as the case may be, actually making possible a further transport of the banknote 3 already partially picked from the banknote stack 2 through the singling gap. However, as an alternative to the example represented here, it is also possible to arrange the retaining device 11 statically in the apparatus. Also in this variant the distance from the retaining runners and thereby the width of the singling gap increases during the downward movement of the conveyor belt 4 from the second position shown in FIG. 2 in the direction of the first position shown in FIG. 1, without the necessity of additional measures; the number of components moved during the singling process and the moved mass is kept small thereby.

Preferably the second diverting roll 8 moves synchronously with the first diverting roll 7 in the fashion that a shortening or lengthening of the conveyor belt 4 connected to the lifting or lowering of the conveyor belt 4 is compensated at least partially by a corresponding positioning of the second diverting roll 8. In the present example both the first diverting roll 7 and the second diverting roll 8 perform an eccentric movement, wherein the second diverting roll 8 is disposed in an upper position when the first diverting roll 7 is disposed in a lower position (see FIG. 1), and the second diverting roll 8 is disposed in a lower position, when the first diverting roll 7 is disposed in an upper position (see FIG. 2). The two eccentric movements of the first and the second diverting roll 7 and 8 preferably have a fixed mutual phase difference of approximately 180°.

The above-described movement of the first and the second diverting roll 7 and 8 is realized by a gearing 10, the preferred construction and function of which is described in greater detail with reference to the FIGS. 3 and 4. The gearing 10 has a first gearwheel 17 driven by a (not shown) motor, and a second gearwheel 18 coupled with the first gearwheel 17. The first diverting roll 7 is mounted to be freely rotatable on a first shaft 15 that is attached eccentrically to the first gearwheel 17, i.e. the first shaft 15 is attached to the first gearwheel 17 outside of the rotational axis of the latter. Correspondingly, the second diverting roll 8 is rotatably mounted on a second shaft 16, wherein the second shaft 16 is attached to the second gearwheel 18 outside of the rotational axis of the latter.

Figure 3:
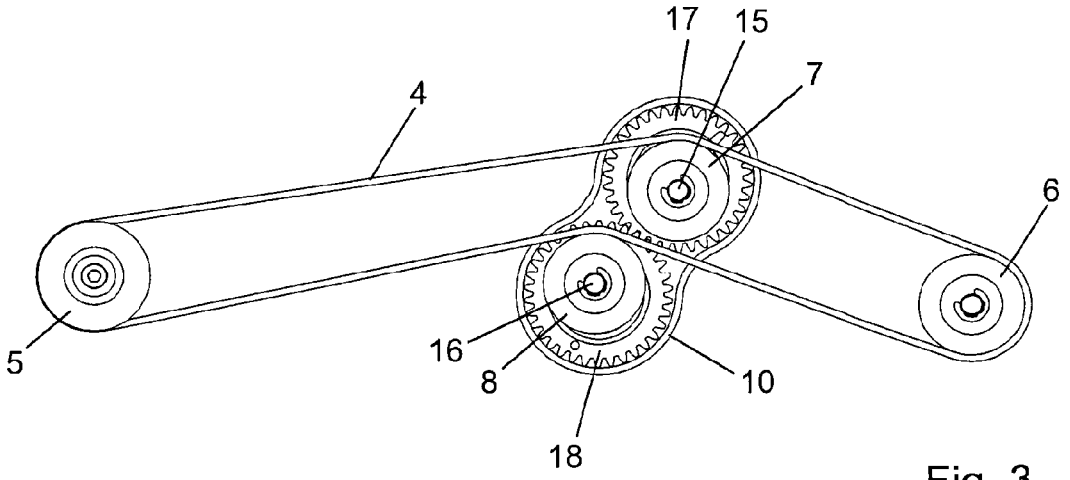
FIG. 3 an example of a gearing of the apparatus shown in FIG. 1 with the first diverting roll disposed in the lower position.
Figure 4:
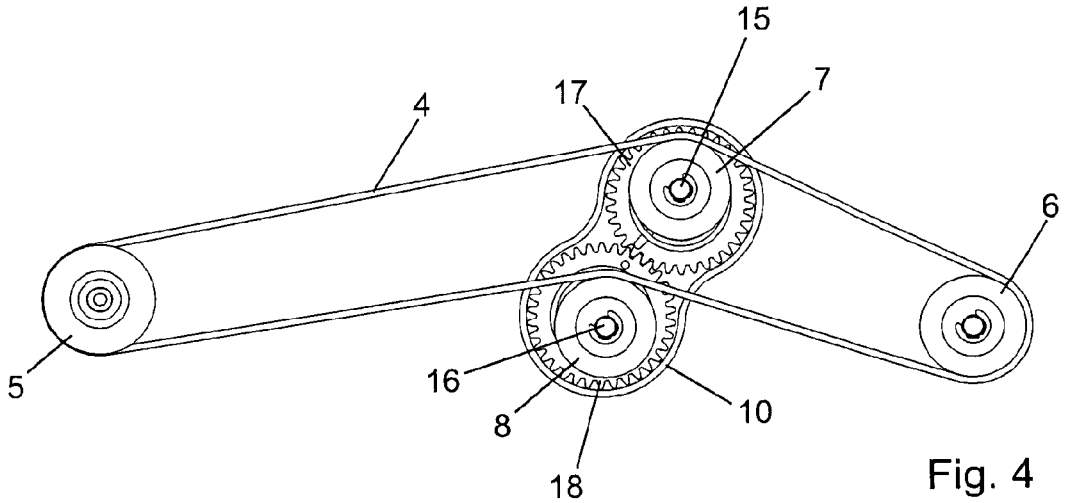
FIG. 4 the gearing shown in FIG. 3 with the first diverting roll disposed in the upper position.

In the phase shown in FIG. 3 the first diverting roll 7 is disposed in its lowest position, while the second diverting roll 8 is disposed in its uppermost position. When the first gearwheel 17 is caused to rotate and is rotated by approximately 180° for example by a stepper motor, the first diverting roll 7 is brought from the lowest position shown in FIG. 3 to the uppermost position shown in FIG. 4. Due to the mechanical coupling of the two gearwheels 17 and 18 therein the second gearwheel 18 is caused to rotate in the opposite direction, wherein the second diverting roll 8 eccentrically arranged on the second gearwheel 18 is brought to a lowest position. The state shown in FIG. 4 is thus reached, wherein the upper portion of the conveyor belt is lifted in comparison to the state shown in FIG. 3, and the lower portion of the conveyor belt is lowered in comparison to the state shown in FIG. 3. A lengthening of the conveyor belt 4 required for lifting the upper portion of the conveyor belt 4 is compensated by lowering the lower portion of the conveyor belt 4.

Alternatively or additionally it is also possible, however, to configure the conveyor belt 4 to be elastic, in order to make changes in the length of the conveyor belt 4 possible at least partially.

Alternatively or additionally it is also possible to compensate possible differences in length by means of a belt tightener that is spring-biased with reference to the conveyor belt 4 and—analogously to the upward and downward movements of the second diverting roll 8 described in connection with the FIGS. 3 and 4—permits an upward or downward counter-movement of the lower portion of the conveyor belt 4.

The above-described compensation of differences in length with the aid of the second diverting roll 8 has the special advantage in comparison to an elastic conveyor belt and a spring-biased belt tightener, however, that here no additional driving power is required to perform the work required by the elastic deformation of the conveyor belt 4 or by the spring-biased belt tightener.

In order to be able to determine a certain width of the singling gap or a certain variation of the width of the singling gap in a targeted fashion, the conveyor belt 4 can be supported by a sustaining element in the region below the singling gap. This will be explained in more detail with reference to FIGS. 5 to 8, wherein otherwise the explanations in connection with the first exemplary embodiment shown in the FIGS. 1 to 4 are applicable correspondingly.

Figure 5:
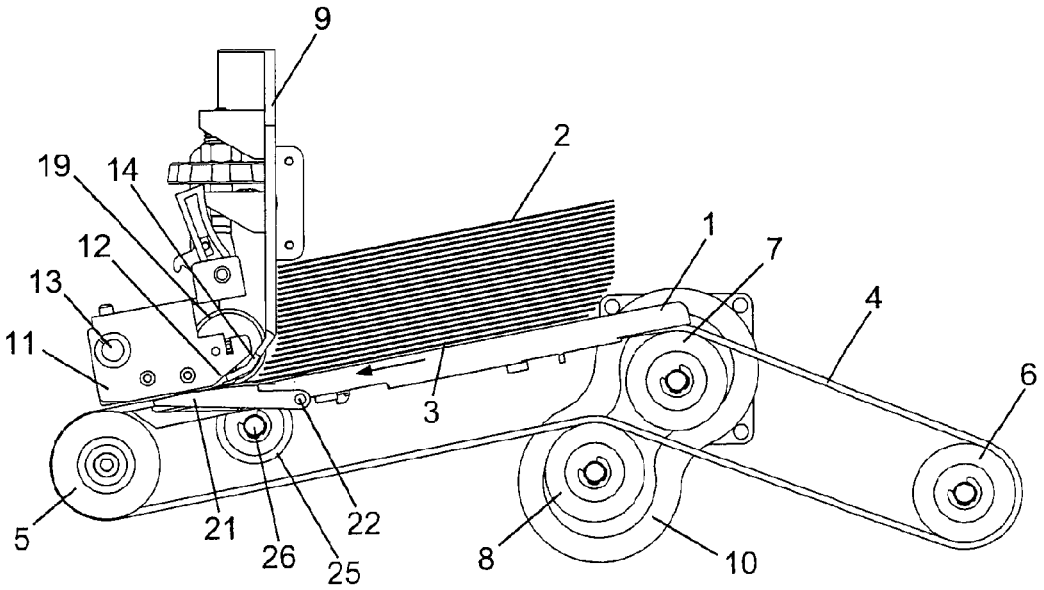
FIG. 5 a second example of the apparatus according to the invention in a side view with the first diverting roll disposed in the lower position.
Figure 6:
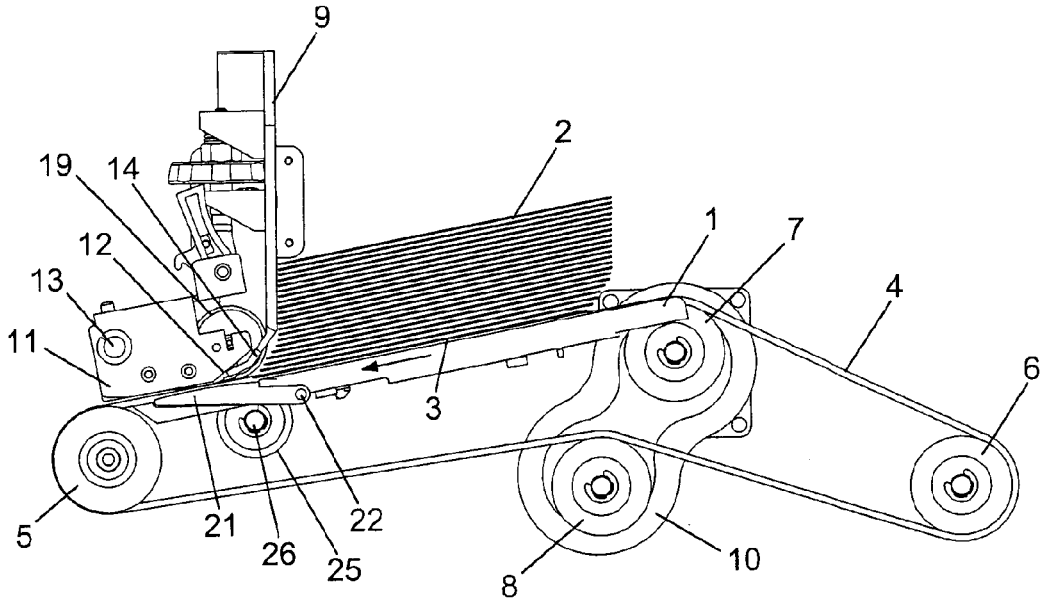
FIG. 6 the second example shown in FIG. 5 with the first diverting roll disposed in the upper position.

In the exemplary embodiment shown in the FIGS. 5 and 6 a sustaining element formed by a third diverting roll 25 that is freely rotatable about an axis 26 is provided to support the conveyor belt 4. The third diverting roll 25 herein is so arranged relative to the upper portion of the conveyor belt 4 extending between the drive roller 5 and the first diverting roll 7 that the upper portion of the conveyor belt 4 rests on the third diverting roll 25 in every phase of the movement between the first and the second position of the conveyor belt 4.

Figure 7:
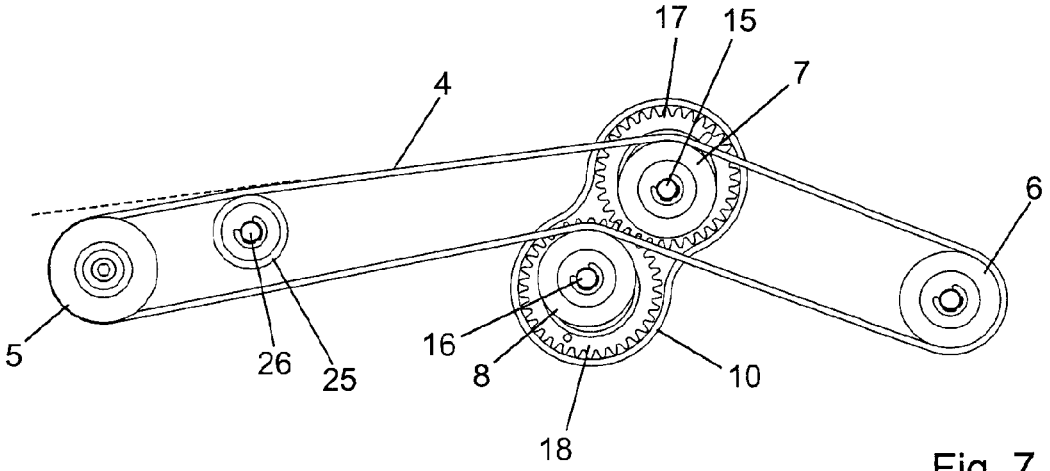
FIG. 7 a representation of a gearing of the apparatus shown in FIG. 5 with the first diverting roll disposed in the lower position.
Figure 8:
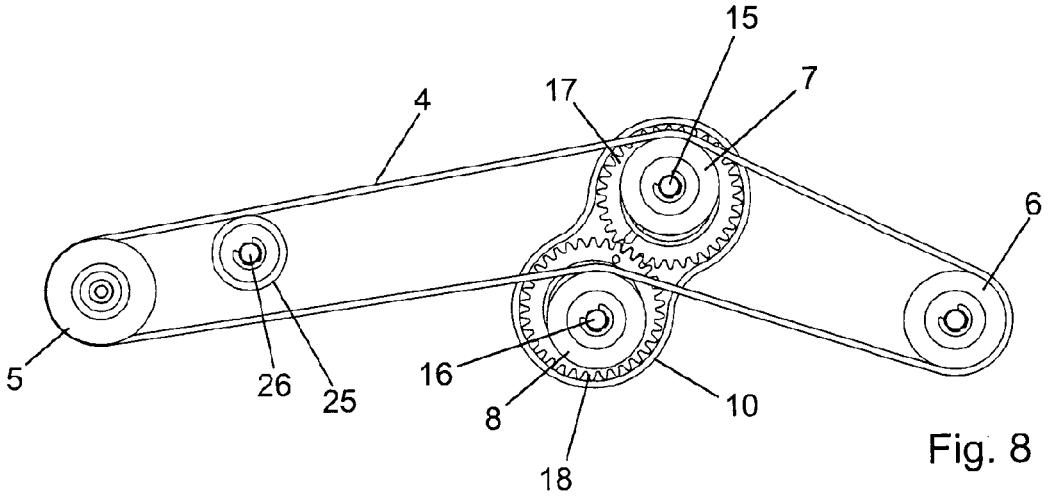
FIG. 8 a representation of the gearing of the apparatus shown in FIG. 5 with the first diverting roll disposed in the upper position.

As can be gathered from the FIGS. 7 and 8, the right portion of the conveyor belt 4 disposed in the first position is slightly diverted by the third diverting roll 25 in comparison to the portion disposed to the left of said portion, as recognizable by means of the extension drawn as a dashed line of the right part of the conveyor belt 4 beyond the third diverting roll 25. In contrast thereto, the conveyor belt 4 disposed in the second position is not or not substantially diverted by the third diverting roll 25. The distance of the diverting roll 25 to the retaining runners of the retaining device 11 can preferably be adjusted in a defined fashion at least during assembly or for maintenance purposes. Alternatively or additionally the third diverting roll 25 can also be so configured and/or moved, however, that its distance to the retaining runners of the retaining device 11 changes during the oscillating movement of the conveyor belt 4. In total, the width of the singling gap can be adjusted in a targeted fashion by the third diverting roll 25, in particular kept constant or changed in a targeted fashion.

As already explained in more detail in connection with the exemplary embodiment shown in the FIGS. 1 and 2, also in this exemplary embodiment the retaining device 11 can be configured to be pivotal about the pivot axis 13 or can be arranged stationarily. The above explanations are applicable correspondingly in this regard.

Figure 9:
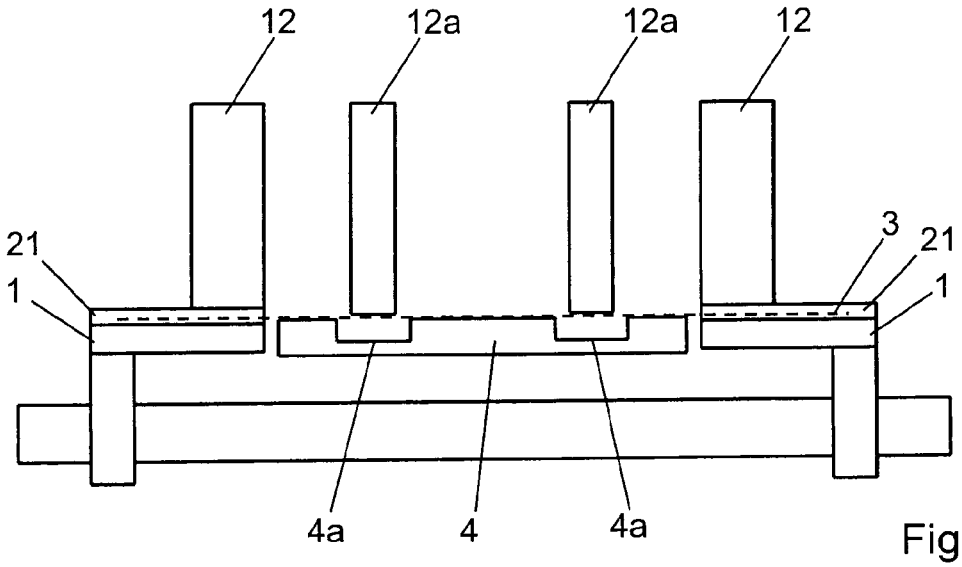
FIG. 9 a cross-sectional representation of an example of the apparatus according to the invention with blocking elements in an active position.
Figure 10:
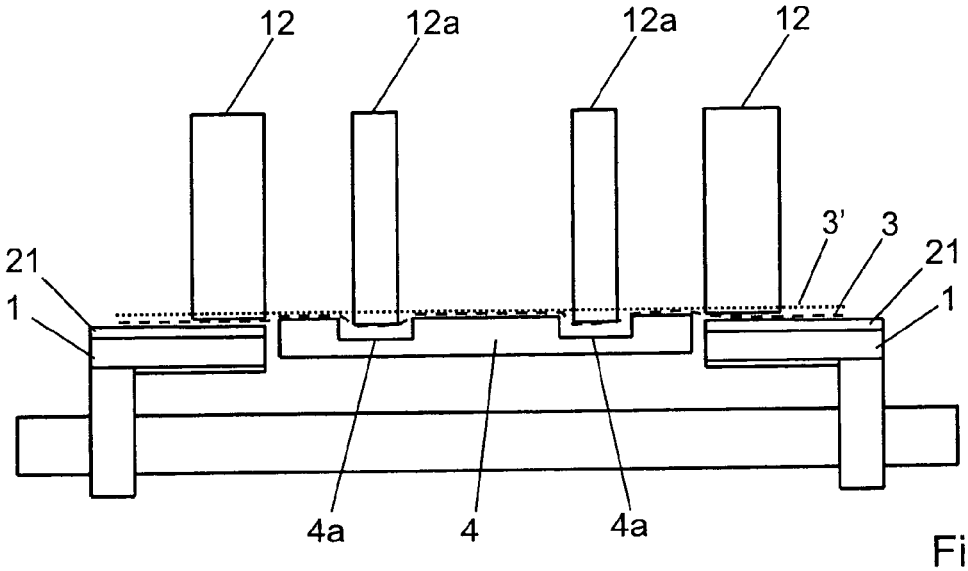
FIG. 10 the representation shown in FIG. 9 with blocking elements in an inactive position.

In the following, the function of the singling apparatus as well as the corresponding method will be explained in more detail on the basis of different phases, wherein, in addition to the FIGS. 1 to 8, reference will be made in particular to the FIGS. 9 and 10, showing respectively a cross-sectional view of an example of the apparatus according to the invention.

In a first phase the diverting roll 7 and thereby also the conveyor belt 4 are disposed in the lower position, where the conveyor belt 4 has no contact to the banknote stack 2 lying on the support means 1, in particular to the lowermost banknote 3, since the conveyor belt 4 is disposed below the support means 1.

Preferably the retaining device 11, to which the two outer retaining runners 12 and two inner retaining runners 12*a* are attached, has an adjustment drive of its own, which makes possible an essentially vertical adjustment of the height of the retaining runners 12 and 12*a* relative to the support means 1 and/or to the conveyor belt 4.

In the conveyor belt 4 grooves 4*a* are provided to which the two inner retaining runners 12*a* are oriented, so that the latter can possibly mesh with the grooves 4*a*. In the phase represented in FIG. 9 the conveyor belt 4 is at the greatest distance to the retaining runners 12*a*, so that these do not mesh with the conveyor belt 4.

In a second phase, by a rotation of the first gearwheel 17, the first diverting roll 7 and thereby also the upper portion of the conveyor belt 4 is lifted, wherein the conveyor belt 4 continuously passes the plane of the support means 1 formed by the two support strips and finally enters into contact with the lowermost banknote 3 of the banknote stack 2 lying on the support means 1. The contacting of the banknote 3 here starts from its front edge facing the retaining device 11. Optionally, the retaining device 11 is continuously moved in the direction of the conveyor belt 4, so that the inner retaining runners 12*a* gradually dip into the grooves 4*a* of the conveyor belt 4, thereby producing a meshing.

In a third phase shown in FIG. 10, further rotation of the first gearwheel 17 brings the first diverting roll 7 and thereby also the conveyor belt 4 to the uppermost position, wherein the conveyor belt 4 now touches over its complete length the lowermost banknote 3 of the banknote stack 2. The meshing of the inner retaining runners 12*a* with the conveyor belt 4 and the banknote 3 disposed in between is the strongest during this phase, so that successive banknotes in the banknote stack 2, in particular the next banknote 3' drawn exemplarily in FIG. 10, are effectively prevented from passing the singling gap by abutting on retaining runners 12 and 12*a*.

During the second and third phase the lower banknotes of the banknote stack 2 are transported in the direction of the singling gap, wherein, due to the friction conditions between the retaining runners 12*a* and the conveyor belt 4, only the respectively lowermost banknote 3 can be transported through the singling gap.

In a fourth phase the downward movement of the first diverting roll 7 starts after its having passed the upper reversal point. In so doing, the contact of the conveyor belt 4 to the banknote stack 2 is successively reduced, starting with the rear edge of the banknote 3. Optionally, the retaining device 11 and the retaining runners 12*a* along with it are additionally lifted from the conveyor belt 4.

In a fifth phase the lower reversal point corresponding to the first position of the conveyor belt 4 is reached again, so that, due to the then existing lack of meshing between the conveyor belt 4 and the retaining runners 12, the remaining length of the lower banknote 3 not yet completely picked from the banknote stack 2 is transported away at low resistance. The transport away itself is effected by a transport device provided downstream from the retaining device 11.

In the first phase represented in FIG. 9 additional blocking elements 21 are pivoted against the outer retaining runners 12 in order to efficiently prevent a further singling of banknotes from the banknote stack 2. In the third phase illustrated in FIG. 10 the blocking elements 21 are somewhat pivoted away from the outer retaining runners 12 in contrast, so that the lowermost banknote 3 of the banknote stack 2 picked by the conveyor belt 4 can be transported below the retaining runners 12 and 12*a* and past these. Preferably the blocking elements 21 are pivoted against the outer retaining runners 12 at a certain point in time between the second phase and the fifth phase, wherein the point in time can be chosen for example in dependence on the respectively currently singled banknote 3 or also in advance, i.e. during production.

The invention claimed is:

1. An apparatus for singling value documents, comprising:

a support means;

a conveyor belt for picking a single value document from a stack of value documents lying on the support means, at least a portion of the conveyor belt being movable back and forth relative to the support means between a first position and a second position, wherein the conveyor belt in the first position cannot touch the stack lying on the support means, and the conveyor belt in the second position can touch the lowermost value document of the stack lying on the support means, and thereby can pick the value document from the stack at least partially;

a positioning device in direct contact with the conveyer belt, the positioning device moving the conveyor belt between the first and second positions; and a compensating element in direct contact with the conveyor belt, the compensating element moving the conveyor belt to compensate for changes in lengths of portions of the conveyor belt that occur when positioning the conveyor belt, the compensation of the compensating element reducing mechanical stress of the conveyor belt to a minimum, the compensating element being coupled to the positioning device such that movement of the positioning device to move the conveyor belt from the first position to the second position causes a synchronous counter-movement, opposite to the movement direction of the positioning device, of the compensating element to move the conveyor belt and reduce mechanical stress of the conveyor belt;

wherein the positioning device comprises a first diverting element configured to divert the conveyor belt such that substantially linearly extending portions of the conveyor belt adopt different angles on the two sides of the diverting element.

2. The apparatus according to claim 1, wherein the support means is so configured that it stands still during the movement of the conveyor belt between the first and the second position.

3. The apparatus according to claim 1, wherein the positioning device comprises the first diverting element including a first diverting roll in direct contact with the conveyor belt, for diverting the conveyor belt.

4. The apparatus according to claim 3, wherein the compensating element comprises a second diverting element including a second diverting roll, for diverting the conveyor belt.

5. The apparatus according to claim 3, wherein the first diverting element comprises a rotatory movement component and a translator movement component.

6. The apparatus according to claim 4, wherein the first diverting element and/or the second diverting element comprises a rotatory movement component and a translator movement component.

7. The apparatus according to claim 4, wherein the first and second diverting element are so mutually coupled that along with a movement of the first diverting element a synchronous counter-movement of the second diverting element takes place.

8. The apparatus according to claim 7, wherein the first diverting element is arranged on a first gearwheel and the second diverting element is arranged on a second gearwheel, and the first and the second gearwheel are mutually engaged.

9. The apparatus according to claim 8, wherein the first diverting element is arranged eccentrically to the rotational axis of the first gearwheel, and wherein the second diverting element is arranged eccentrically to the rotational axis of the second gearwheel.

10. The apparatus according to claim 1, wherein the conveyor belt can be moved back and forth between the first position and the second position by an oscillating, periodical movement of the positioning device.

11. The apparatus according to claim 1, having one or several retaining elements, by which the further value documents of the stack can be retained while the lowermost value document of the stack that is picked from the stack at least partially can be conveyed through a singling gap disposed between the retaining elements and the support means and/or the conveyor belt.

12. The apparatus according to claim 11, having a third diverting element including a third diverting roll for diverting the conveyor belt, which is arranged in the region of the retaining elements and by which the width of the singling gap between the retaining elements and the conveyor belt can be predetermined.

13. The apparatus according to claim 11, having at least one blocking element, which can be guided towards at least a part of the retaining elements and can prevent a picking of further value documents from the stack, while the lowermost value document picked from the stack at least partially is conveyed through the singling gap.

14. A value-document processing system having an apparatus for processing including conveying and/or checking and/or counting and/or sorting value documents, wherein an apparatus according to claim 1.

15. A method for singling value documents wherein the lowermost value document of a stack of value documents lying on a support means is picked by means of a conveyor belt, wherein at least a portion of the conveyor belt is moved back and forth between a first position and a second position relative to the support means by a positioning device in direct contact with the conveyer belt, wherein the conveyor belt in the first position does not touch the stack lying on the support means, and the conveyor belt in the second position touches the lowermost value document of the stack lying on the support means, thereby picking the lowermost value document from the stack at least partially, and wherein a compensating element in direct contact with the conveyor belt moves to compensate for changes in lengths of portions of the conveyor belt that occur when positioning the conveyor belt, the compensation of the compensating element reducing mechanical stress of the conveyor belt to a minimum, the compensating element being coupled to the positioning device such that movement of the positioning device to move the conveyor belt from the first position to the second position causes a synchronous counter-movement, opposite to the movement direction of the positioning device, of the compensating element to move the conveyor belt and reduce mechanical stress of the conveyor belt;

wherein the positioning device comprises a first diverting element configured to divert the conveyor belt such that substantially linearly extending portions of the conveyor belt adopt different angles on the two sides of the diverting element.

16. An apparatus for singling value documents, comprising:

a support means;

a conveyor belt for picking a single value document from a stack of value documents lying on the support means, at least a portion of the conveyor belt being movable back and forth relative to the support means between a first position and a second position, wherein the conveyor belt in the first position cannot touch the stack lying on the support means, and the conveyor belt in the second position can touch the lowermost value document of the stack lying on the support means, and thereby can pick the value document from the stack at least partially; and a positioning device that moves the conveyor belt between the first and second positions, the positioning device comprising:

first and second gearwheels mutually engaged, the first and second gearwheels each having a rotational axis; and first and second diverting elements for diverting the conveyor belt, the first and second diverting elements being mutually coupled such that movement of the first diverting element to move the conveyor belt from the first position to the second position causes a synchronous counter-movement of the second diverting element to move the conveyor belt and reduce mechanical stress of the conveyor belt, the first diverting element being arranged eccentrically to the rotational axis of the first gearwheel and the second diverting element being arranged eccentrically to the rotational axis of the second gearwheel.

17. An apparatus for singling value documents, comprising:

a support means;

a conveyor belt for picking a single value document from a stack of value documents lying on the support means, at least a portion of the conveyor belt being movable back and forth relative to the support means between a first position and a second position, wherein the conveyor belt in the first position cannot touch the stack lying on the support means, and the conveyor belt in the second position can touch the lowermost value document of the stack lying on the support means, and thereby can pick the value document from the stack at least partially;

a positioning device in direct contact with the conveyer belt, the positioning device moving the conveyor belt between the first and second positions; and a compensating element in direct contact with the conveyor belt, the compensating element moving the conveyor belt to compensate for changes in lengths of portions of the conveyor belt that occur when positioning the conveyor belt, the compensation of the compensating element reducing mechanical stress of the conveyor belt to a minimum, the compensating element being coupled to the positioning device such that movement of the positioning device to move the conveyor belt from the first position to the second position causes a synchronous counter-movement of the compensating element to move the conveyor belt and reduce mechanical stress of the conveyor belt;

wherein the positioning device is arranged on a first gearwheel and the compensating element is arranged on a second gearwheel, and the first and the second gearwheel are mutually engaged.

* * * * *